US007306501B2

(12) United States Patent
Pierce, Jr. et al.

(10) Patent No.: US 7,306,501 B2
(45) Date of Patent: Dec. 11, 2007

(54) INFLATABLE AQUATIC RESCUE COLLAR

(76) Inventors: Kenney Joe Pierce, Jr., 955 Opal St., San Diego, CA (US) 92109; William David Pierce, 7105 Oak Village Way, Fuquay-Varina, NC (US) 27526

( * ) Notice: Subject to any disclaimer, the term of this patent is extended or adjusted under 35 U.S.C. 154(b) by 0 days.

(21) Appl. No.: 11/277,644

(22) Filed: Mar. 28, 2006

(65) Prior Publication Data

US 2006/0217014 A1 Sep. 28, 2006

Related U.S. Application Data

(60) Provisional application No. 60/665,191, filed on Mar. 28, 2005.

(51) Int. Cl.
*B63C 9/00* (2006.01)

(52) U.S. Cl. ..... 441/83; 441/84; 182/3

(58) Field of Classification Search ..... 441/80, 441/81, 83, 84, 87; 182/3, 6
See application file for complete search history.

(56) References Cited

U.S. PATENT DOCUMENTS 0,634,445 A 10/1899 Wilde
1,487,923 A 3/1924 DeVilbiss
2,890,467 A 6/1959 Cowell
3,077,618 A * 2/1963 O'Link ..... 441/113
3,710,409 A 1/1973 Davidson
4,599,073 A * 7/1986 Fryer et al. ..... 441/80
5,010,850 A 4/1991 Sailer
5,279,386 A 1/1994 Cearley
5,348,504 A 9/1994 Pierce et al.
5,584,736 A 12/1996 Salvemini
5,690,524 A 11/1997 Salvemini
5,702,279 A 12/1997 Brown
5,813,891 A * 9/1998 McNamee ..... 441/108
5,839,932 A 11/1998 Pierce et al.
6,050,869 A * 4/2000 Kellett ..... 441/83

* cited by examiner

*Primary Examiner*—Lars A. Olson
(74) *Attorney, Agent, or Firm*—Quickpatents, Inc.; Kevin Prince

(57) ABSTRACT

An inflatable rescue collar is disclosed. The collar is formed of an elongated inflatable cylindrical tube having appropriate ends and which is of a size to extend around the upper torso of an individual. The bladder is generally toroidal in cross-section and defines an open channel along the length thereof through which a web strap extends. The strap is constructed such that it may be cinched adjacent the free ends thereof so as not to bind on an individual, or clipped so as to be capable of applying a compressive force about the upper torso of an individual.

8 Claims, 3 Drawing Sheets

24
20
14'
25
45
12
10

24'
22
24
21

21
22
24
24
35

21
22
24
35
24

INFLATABLE AQUATIC RESCUE COLLAR

PRIORITY CLAIM

This application claims the benefit of Applicants' provisional patent application 60/665,191, filed on Mar. 28, 2005.

BACKGROUND OF THE INVENTION

1. Field of the Invention

This invention is generally directed to lifesaving equipment of a type utilized in aquatic environments and, more specifically, to an inflatable rescue collar which is of a size to extend around the upper torso of an individual and which contains a reinforcing web strap.

2. History of the Related Art

In the field of water rescue and safety, there are a number of conventional devices which have been designed to facilitate victim flotation and emergency extraction of a victim from the water. The most basic lifesaving equipment is designed to be utilized by casting a flotation device to a victim in the water. Conventional lifesaving rings constructed of buoyant materials are standardly utilized at private and public swimming pools and on water craft. In some instances, such lifesaving rings or buoys are tethered to a throwline, allowing the rings to be pulled back to a side of a pool, shore or the deck of a boat once the victim has appropriately grasped the flotation ring. Such rescue equipment id generally used where a lifesaving victim has sufficient presence of mind to grasp the flotation device when it is thrown into the water.

There are, however, many instances or situations wherein a person in the water is unable to take affirmative action to assist in their own rescue. The victim may be injured, unconscious or panicked thus necessitating a rescuer to enter the water to provide lifesaving assistance. Many water rescues also take place far from shore where victims must be lifted into rescue water craft or aircraft. In many of the foregoing situations, there are two basic steps which are required to enable a successful rescue. First, the victim must be stabilized or secured. In an aquatic environment, this means that the victim must be made buoyant and supported in such a position that the victim can breathe, even if unconscious. Second, the victim must be safely lifted to a rescue vehicle without injury.

There are a number of prior art water rescue safety devices which are designed to provide victim stabilization, or flotation, and other devices that have been specifically designed for lifting. However, most such devices do not provide for both victim flotation and lifting. Although some rescue devices have been designed to provide both flotation and lifting, they are often not adequately designed or constructed to withstand the forces which are exerted when a person is pulled from the water during a rescue. Buoyant collars and the like which claim to be useful for lifting can fail when these stresses are exerted upon the collar due to the weight of the victim.

In applicants' previously issued patent, U.S. Pat. No. 5,348,504, an inflatable lifesaving apparatus is disclosed which is specifically designed to assist rescuers by providing an inflatable flotation device which may be easily placed around the upper torso of a victim and beneath their arms in such a manner that the victim is assured of floating in a face-up position. The apparatus also assured that the rescuer could remain out of the persons grasp by allowing a rescuer to approach and then maneuver the victim from the rear. The teachings of U.S. Pat. No. 5,348,504 are hereby incorporated herein by reference.

In another of applicants previously issued patent, U.S. Pat. No. 5,839,932, a multi-purpose rescue gear assembly is disclosed which includes a portable belt and storage pouches which house a flotation device and lift collar which can be used together in a rescue situation. The teachings of this patent are also incorporated herein by reference.

Additional examples of prior are aquatic rescue gear are disclosed in U.S. Pat. No. 634,445 to Wilde, U.S. Pat. No. 1,487,923 to DeVilbiss, U.S. Pat. No. 2,890,467 to Cowell, U.S. Pat. No. 3,710,409 to Davidson, U.S. Pat. No. 5,010,850 to Sailer, U.S. Pat. No. 5,279,386 to Cearley, U.S. Pat. No. 5,702,279 to Brown and U.S. Pat. No. 5,584,736 and U.S. Pat. No. 5,690,524 to Salvemini.

SUMMARY OF THE INVENTION

The present invention is directed to a collar formed of an elongated inflatable cylindrical tube or bladder having appropriate ends and which is of a size to extend around the upper torso of an individual. The bladder is generally toroidal in cross sectional configuration defining an open channel along the length thereof through which a web strap extends. The strap is constructed such that it may be cinched adjacent the free ends thereof so as not to bind on an individual or clipped so as to apply compressive force about the upper torso of an individual.

It is the primary object of the invention to provide an aquatic lifesaving collar featuring a lifting harness strap which is constructed such that it may be affixed around an individual so as not to bind on the individual and which is partially enclosed in an inflatable buoyant member which member also provides a cushion between the strap and the individual to provide greater comfort and prevent accidental injury when lifting.

It is yet another object of the present invention to provide an aquatic safety collar including a strap which is cinched so as to apply compressive force about the upper torso of an individual who is unconscious.

BRIEF DESCRIPTION OF THE DRAWINGS

FIG. 8*a* is a partial close-up front elevational view of an alternate configuration where in the rescue line is attached to just one of the D-rings;

DESCRIPTION OF THE PREFERRED EMBODIMENT

Figure 1:
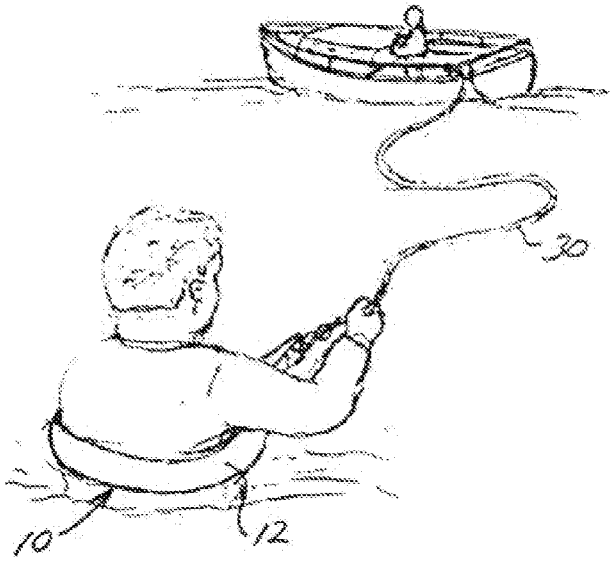
FIG. 1 is an illustrational view of the aquatic rescue collar of the present invention being used in the rescue of an individual from a boat.
Figure 2:
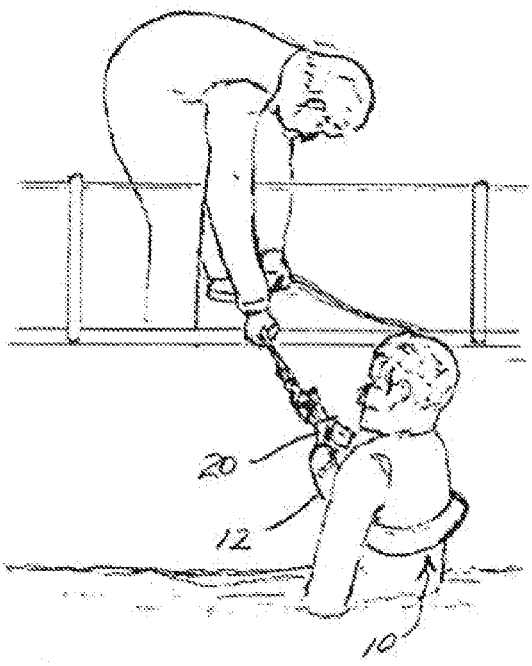
FIG. 2 is an illustrational view of a rescuer lifting a victim out of the water using the aquatic rescue collar of the present invention.
Figure 3:
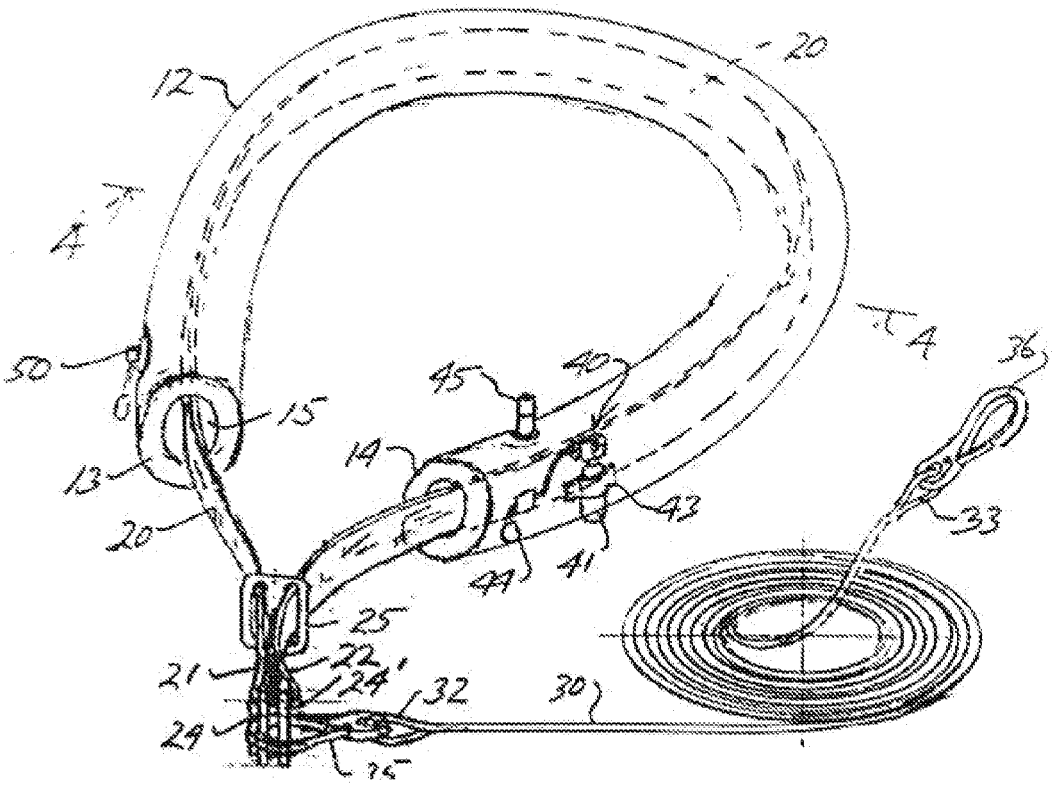
FIG. 3 is a top perspective view of the aquatic rescue collar of the present invention.
Figure 4:
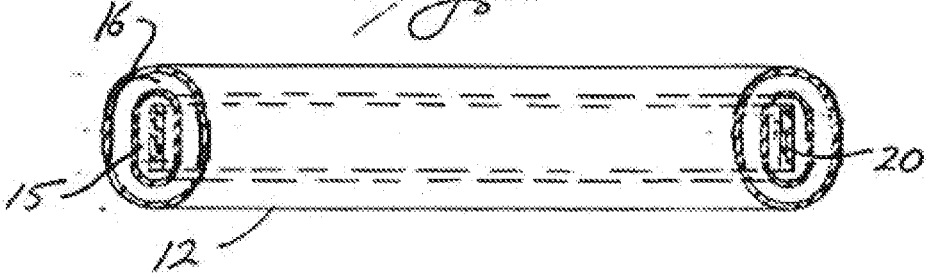
FIG. 4 is a cross-sectional view taken along line 6-6 of FIG. 5.
Figure 5:
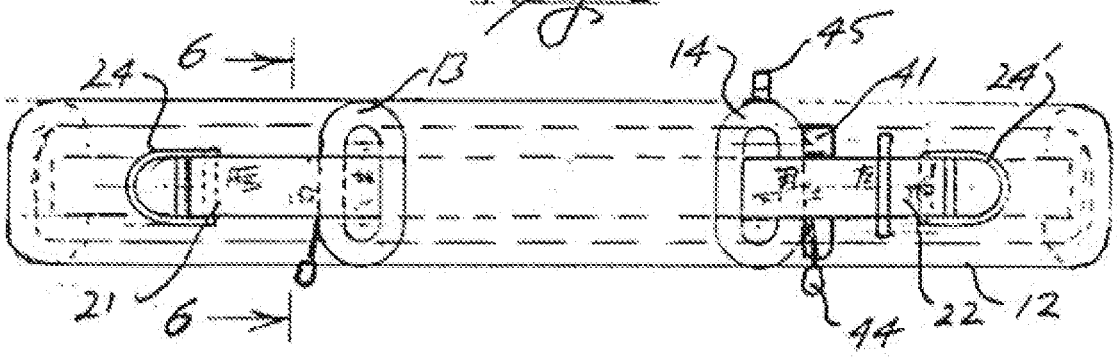
Figure 7:
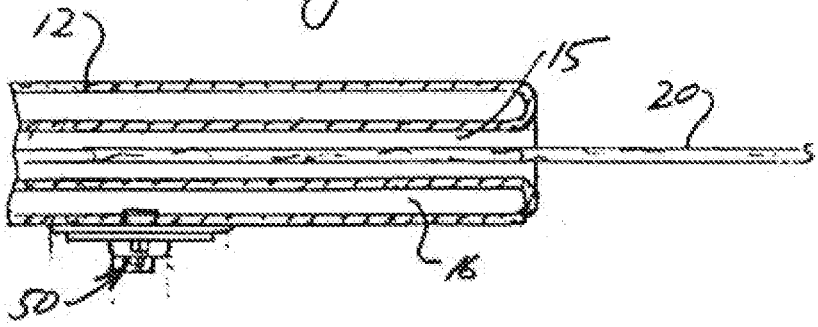
FIG. 7 is a partial cross-sectional view taken along line 7-7 of FIG. 6.

With specific reference to FIGS. 1-3, the present invention is directed to an aquatic rescue collar generally designated by reference numeral 10. The collar 10 includes an elongated toroidal inflatable bladder 12 having appropriate free ends 13 and 14 and through which extends a central open channel 15 (FIGS. 4, 5 and 7). The bladder forms an air chamber 16 sealed from and surrounding the central channel. The air chamber 16 is of a size such, when filled with air, to provide sufficient buoyancy for a large adult.

A web strap 20 extends through the central channel 15 of the inflatable bladder. The strap 20 includes appropriate ends 21 and 22 which extend outwardly of the bladder and pass through a double slot ring 25. D-rings 24 are secured at each end of the strap. The rescue collar 10 is preferably tethered to a rescue line or rope 30. The rescue line 30 has loops 32 and 33 at each end to at least one of which are attached snap hooks 35 and 36, respectively. The snap hook 35 is shown attached to the 2 D-rings 24 while the snap hook 36 is, in use, attached to a fixed support on the rescue vehicle, such as the railing of a boat. The web strap is preferably constructed of a 1¾ inch nylon webbing capable of lifting at least 1,000 lbs.

The bladder is preferably formed in a continuous arcuate configuration from end to end. However, the bladder may also be generally straight and drawn into an arcuate configuration when the strap is inserted therethrough and the ends 21 and 22 secured adjacent to each other by the double slot ring 25.

The collar 10 includes an auto-inflator 40 to enable rapid inflation of the toroidal bladder 12 upon immersion in water. The auto-inflator 40 preferably includes a pressurized gas cartridge 41 which is mounted at 43 to the side of the bladder 12 and which provides pressurized gas to the interior of the bladder 12 when immersed or a cord 44 is pulled.

The collar 10 may also include an oral inflation tube 45 to enable oral inflation of the toroidal bladder 12 in situations where the auto-inflator 40 partially or completely fails. The oral inflation tube 45 includes a one way valve (not shown) to enable air to be blown by an individual into the interior of the bladder 12 while preventing any air from exiting the interior of the bladder 12.

Figure 6:
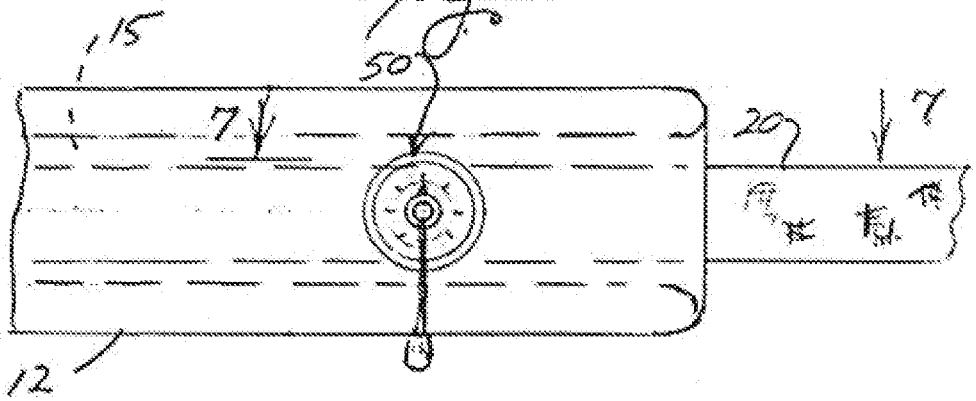
FIG. 6 is a partial side elevational view of the invention, illustrating in more detail a pressure release valve.

The collar 10 also includes a pressure release valve 50 (FIGS. 3 and 6) which is used to release air from the bladder 12 to prevent rupture in case of over inflation and after use so that the bladder 12 can be fitted with another gas cartridge and subsequently folded or rolled for compact storage.

The rescue collar 10 of the present invention is designed to be stored in a pouch (not shown) which may be secured in a storage compartment of a vessel or aircraft or carried by a lifeguard or other rescue worker. When not inflated, the collar 10 is folded or rolled into a compact configuration and may be inserted into a portable pouch such as disclosed in applicants' prior issued U.S. Pat. No. 5,839,932 or into a bag (not shown) which is a self-contained rescue apparatus consisting of the rescue collar 10 and appropriate amount of rescue line 30 in one unit. The rescue line 30 may also be secured to a pouch containing the rescue collar 10 with one end of the rescue line 30 being clipped to a belt or other device as is disclosed in the aforementioned U.S. Pat. No. 5,839,932.

When a rescue is necessary and the victim appears to have sufficient presence of mind to facilitate their rescue, the collar is removed from a pouch or other storage area and thereafter the bladder inflated by immersion in water or pulling the cord for the inflation device 40. Thereafter, the tethered collar member is thrown to the person. In those instances where the victim cannot assist in their own rescue, the rescuer will carry the collar to the area of the victim and thereafter place the collar about the upper torso of the victim and activate the inflator 40.

Figure 8:
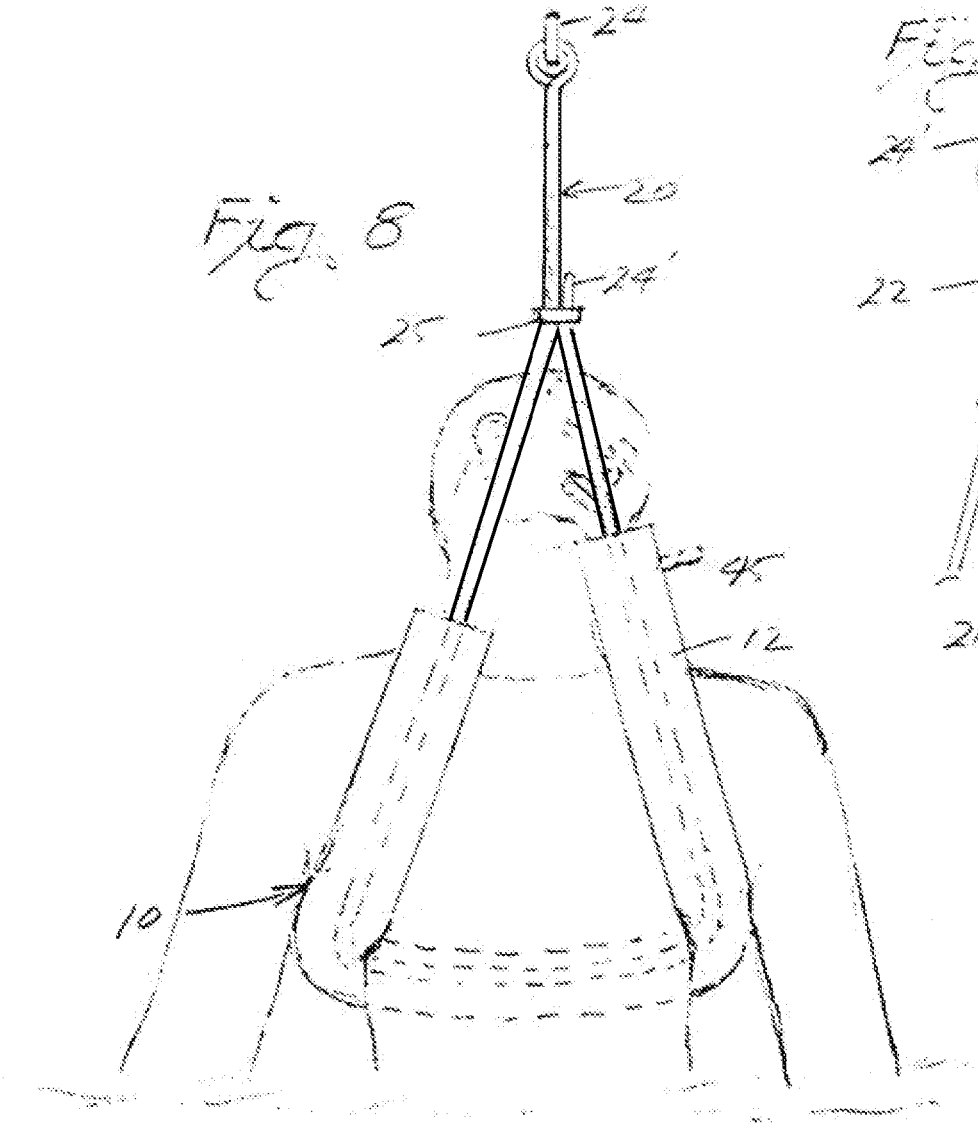
FIG. 8 is an illustrational view of the invention wherein one end of the collar is used to lift a victim so that the collar cinches tightly about the victim.
Figure 5A:
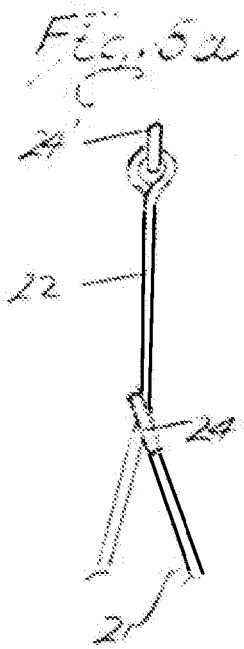
FIG. 5 is a front elevational view of the invention.
Figure 3A:
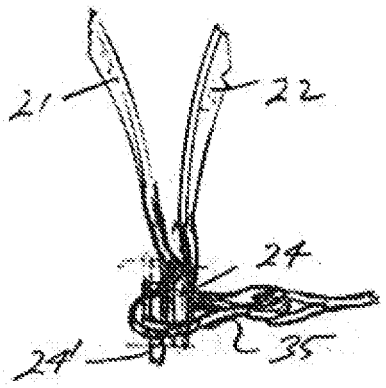
FIG. 3*a* is a partial close-up perspective view illustrating D-rings and a rescue line of the present invention in more detail, the rescue line attached to both D-rings.
Figure 3B:
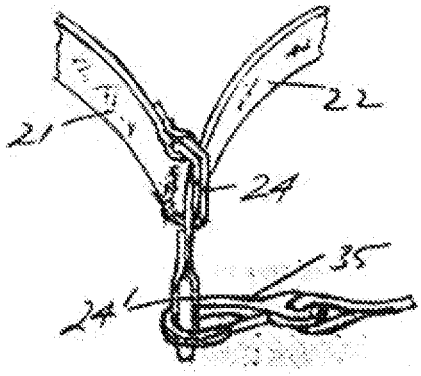
FIG. 3*b* is a partial close-up perspective view illustrating the D-rings and the rescue line of the present invention in more detail, the rescue line attached to just one of the D-rings.

To lift the victim from the water, the collar is placed about the upper torso of the individual. A snap hook 35 of the rescue line 30 is thereafter attached to one or both D-rings 25 and the victim elevated utilizing the line. The compressive pressure of the strap 20 against the upper torso is resisted and cushioned by the surrounding inflated bladder thereby preventing injury to the individual by the strap. In FIGS. 2 and 3*a*, both D-rings 24 are secured to the rescue line. However, if only a single D-ring is connected to the rescue line, as shown in FIGS. 8 and 3*b*, the collar will cinch more tightly about the victim.

When the victim has been safely secured, the rescue collar may be removed and deflated utilizing the pressure release valve 50 or the oral tube 45. Once air is depleted from the bladder, the collar may be compactly rolled.

The foregoing description of the preferred embodiment of the present invention has been presented to illustrate the general principles of the invention and not to limit the invention to any particular embodiment illustrated. It is intended that the scope of the invention be defined by all of the embodiments encompassed within the following claims and any and all equivalents thereof.

We claim:

1. A rescue collar for use in aquatic environments with a rescue line comprising:

an elongated inflatable bladder having first and second ends, said bladder being generally toroidal in cross section so as to define a central passage therethrough which is open at first and second ends;

an elongated strap extending through said passage, said strap having first and second ends, which ends extend out of said first and second ends, respectively, of said bladder;

means for retaining said first and second ends of said strap adjacent to one another, said means for retaining includes a double slot ring through which said first and second ends of said strap are slidingly received; and means extending from at least one of said first and second ends of said strap to connect the rescue line thereto.

2. The rescue collar of claim 1 wherein said means extending from at least one of said first and second ends of said strap includes a D-ring.

3. The rescue collar of claim 1 further comprising a means for automatically inflating said bladder.

4. The rescue collar of claim 2 further comprising means for orally inflating said bladder.

5. The rescue collar of claim 1 further comprising a means for discharging gas from said bladder.

6. The rescue collar of claim 1 wherein said strap is freely slidable within said passage of said bladder.

7. The rescue collar of claim 1 wherein said bladder, when inflated is of sufficient buoyancy to floatably support an individual in water such that the individual's head remains above the water and wherein said strap is composed of sufficient strength to support the weight of the individual when lifted from the water.

8. The rescue collar of claim 7 further comprising a line tethered to the rescue collar device.

* * * * *